United States Patent [19]

Lawrence

[11] Patent Number: 4,466,609

[45] Date of Patent: Aug. 21, 1984

[54] COMPACT SHEET SORTER

[75] Inventor: Frederick J. Lawrence, Tustin, Calif.

[73] Assignee: Gradco Systems, Inc., Santa Ana, Calif.

[21] Appl. No.: 369,473

[22] Filed: Apr. 19, 1982

[51] Int. Cl.[3] ..... B65H 29/58

[52] U.S. Cl. ..... 271/293; 271/219

[58] Field of Search ..... 271/293, 219, 220, 287, 271/292, 294, 295, 217, 218

[56] References Cited

U.S. PATENT DOCUMENTS

| | | | |
|---|---|---|---|
| 3,866,904 | 2/1975 | Stemmle | 271/293 X |
| 3,998,450 | 12/1976 | Howard | 271/293 |
| 4,397,461 | 8/1983 | Dubois | 271/293 |

FOREIGN PATENT DOCUMENTS

| | | | |
|---|---|---|---|
| 151563 | 9/1982 | Japan | 271/293 |

*Primary Examiner*—Richard A. Schacher

*Attorney, Agent, or Firm*—Newton H. Lee, Jr.

[57] ABSTRACT

A sheet sorting machine of the movable bin type has a frame structure which supports a plurality of bins at one end of the bins, adjacent to a sheet entry location, the other ends of the bins being free and spaced for removal of sorted sets of sheets. The bins have pairs of trunnions at opposite sides engageable with one another and by pairs of bins shifting spiral cams to raise and lower the bins in parallelism. The trunnions for the bins and the spiral cams are mounted in spring loaded housing with springs which bias the trunnions into the spiral cams, and a trunnion is always in the cam track of the spiral cams.

4 Claims, 8 Drawing Figures

COMPACT SHEET SORTER

BACKGROUND OF THE INVENTION

The present invention utilizes certain features of and is an improvement in movable bin sorters of the type disclosed in the following prior patents:

Lawrence U.S. Pat. No. 4,343,463

Du Bois and Hamma U.S. Pat. No. 4,328,963

In my above-identified U.S. Pat. No. 4,343,463, movable bin sheet sorting machines are disclosed which are of compact construction. A moving bin structure is employed wherein the ends of the sorting bins or trays adjacent to the sheet entry location are shifted past the sheet entry by spiral cams which engage trunnions at opposite sides of the bins. At their other ends, the bins are pivotally supported so that as each successive bin is moved, a space between bins is provided which diminishes or converges toward the outer end remote from the sheet entry. When a large number of bins is employed, say twenty bins, the angle of the bins can be maintained at a satisfactory incline by shifting the outer pivoted ends of the bins as the inner ends are being shifted, as disclosed in my U.S. Pat. No. 4,337,936, but the angle does change and the space to receive sheets is convergent.

Such sorters have substantial frame structure at the outer ends of the bins forming the support for the bins and containing the shifting means for the outer ends of the bins. Such frame structure inherently encloses the bins at their outer ends so that sets of sheets must be removed laterally from between bins. In the Du Bois and Hamma application identified above, the bins are supported at their outer ends on a lower support and pivotally on one another, so that the sorted sets can be removed either laterally or endwise. However, the bin portions which pivotally engage at the outer ends of the bins pose an obstacle to larger size sheets, and the bin angle changes so that when larger numbers of bins are used, shifting of the outer ends of the bins as the outer ends move to maintain an acceptable angle is desirable, as disclosed in U.S. Pat. No. 4,397,461 of Du Bois and Hamma.

SUMMARY OF THE INVENTION

The present invention provides a movable bin sorting machine which utilizes certain of the desirable characteristics of the prior sorters identified above, while eliminating certain of the functional problems.

More particularly, the present invention has the bins supported in parallel relation at a desired angle to receive sheets, and such parallel relation and angle are maintained throughout the range of movement. Since the adjacent bins are uniformly spaced, the bin capacity is larger than in the case of bins which outwardly converge.

The outer ends of the bins are free, enabling removal of sets of sheets either laterally from the bins or longitudinally. This is accomplished by supporting the bins at their inner ends in a frame structure from which the outer ends of the bins freely project. At their inner ends, the bins at opposite sides have a pair of longitudinally spaced trunnions which contact to maintain a uniform closely spaced relation between the bins above and below a pair of transfer cams. Springs urge the trunnions together. The transfer cams maintain the trays more widely spaced at the sheet entry location, and drive means rotate the four cams simultaneously in opposite directions to transfer the bins past the sheet entry location.

Control means cause the cams to be rotated one revolution in a selected direction after a sheet is fed from a sheet transport into a bin at the entry location.

The cams are formed in such a manner that the trunnions of a bin are in a spiral cam track after each revolution resulting in smoother transition of bins during sorting operations, than in the case of the sorters of my prior applications identified above.

This invention possesses many other advantages and has other purposes which may be made more clearly apparent from a consideration of the forms in which it may be embodied. The preferred form is shown in the drawings accompanying and forming part of the present application. It will now be described in detail, for the purpose of illustrating the general principals of the invention, but it is to be understood that such detailed description is not to be taken in a limiting sense.

DESCRIPTION OF THE PREFERRED EMBODIMENT

Figure 1:
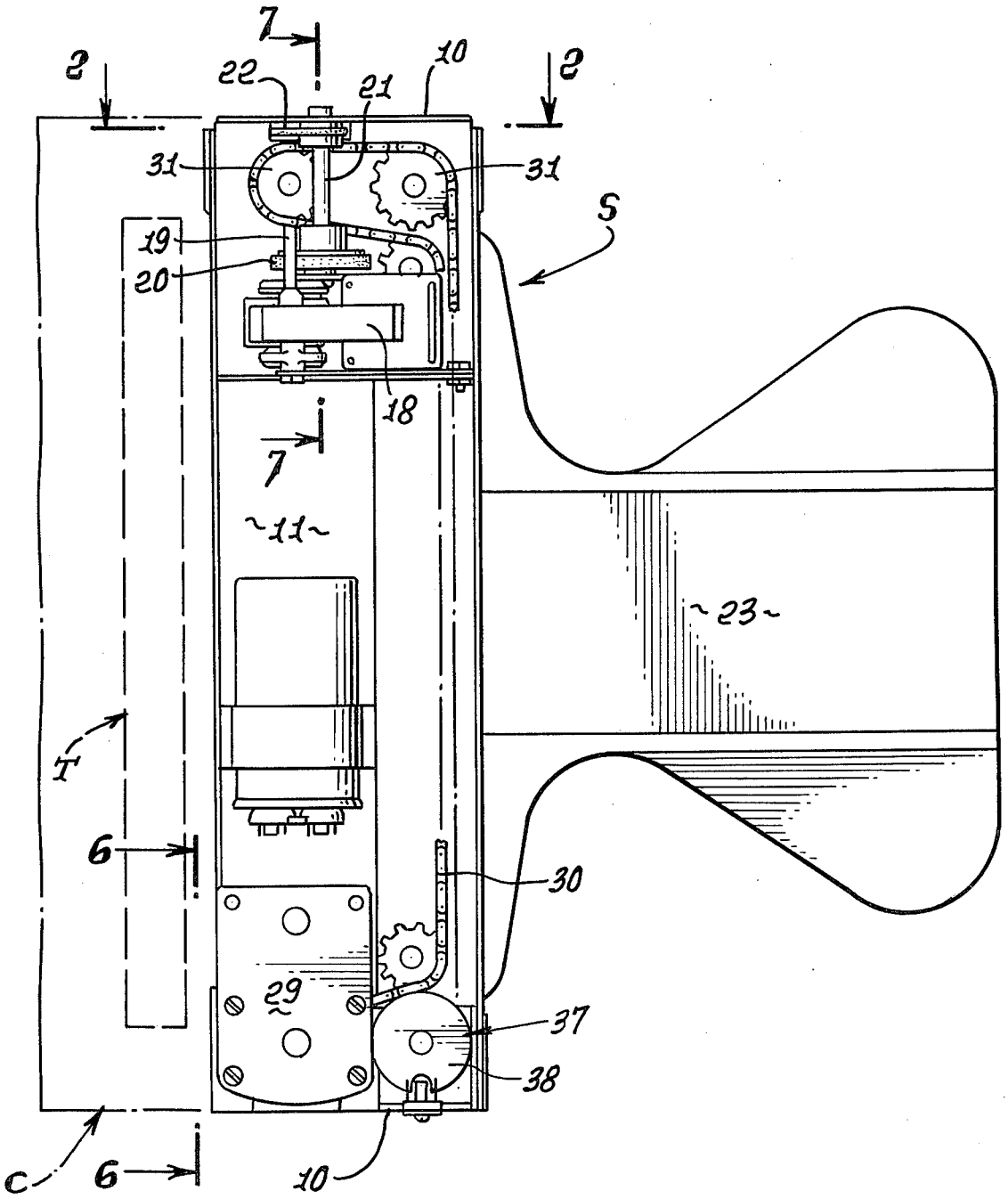
FIG. 1 is a top plan, with the housing removed, showing a sheet sorter in accordance with the invention.
Figure 2:
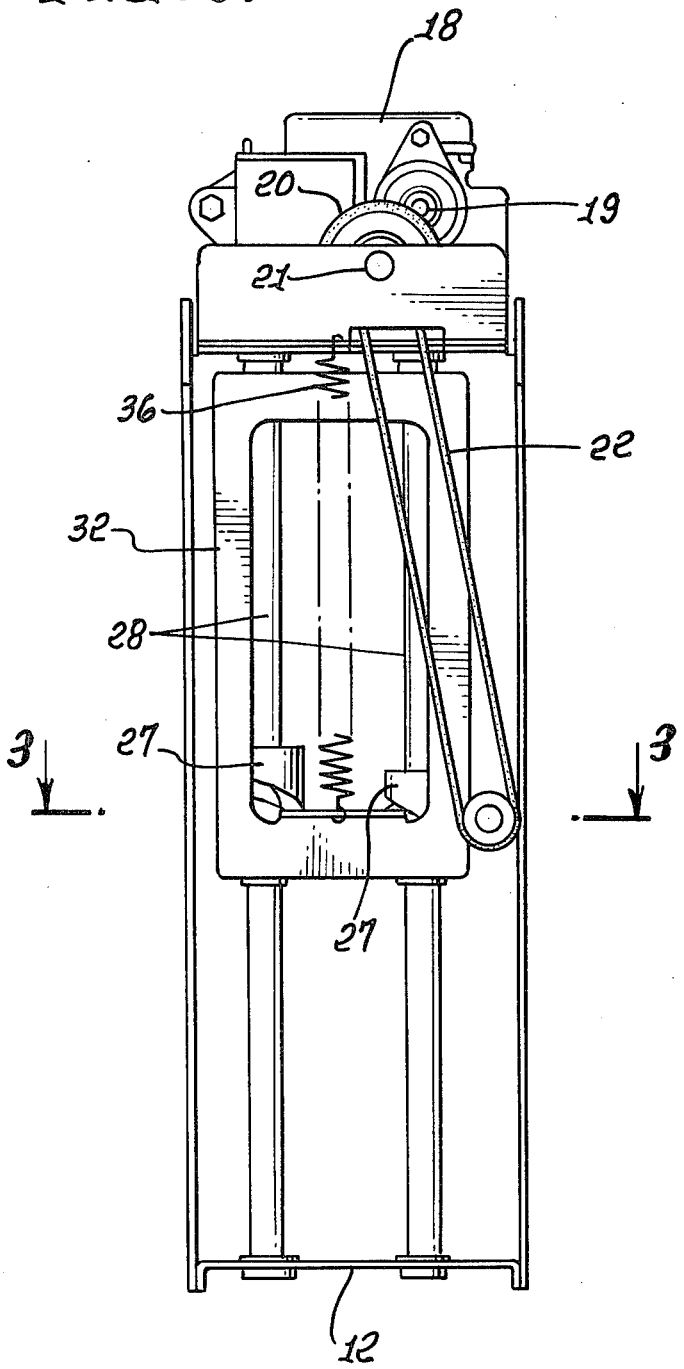
FIG. 2 is a vertical section on the line 2—2 of FIG. 1.
Figure 3:
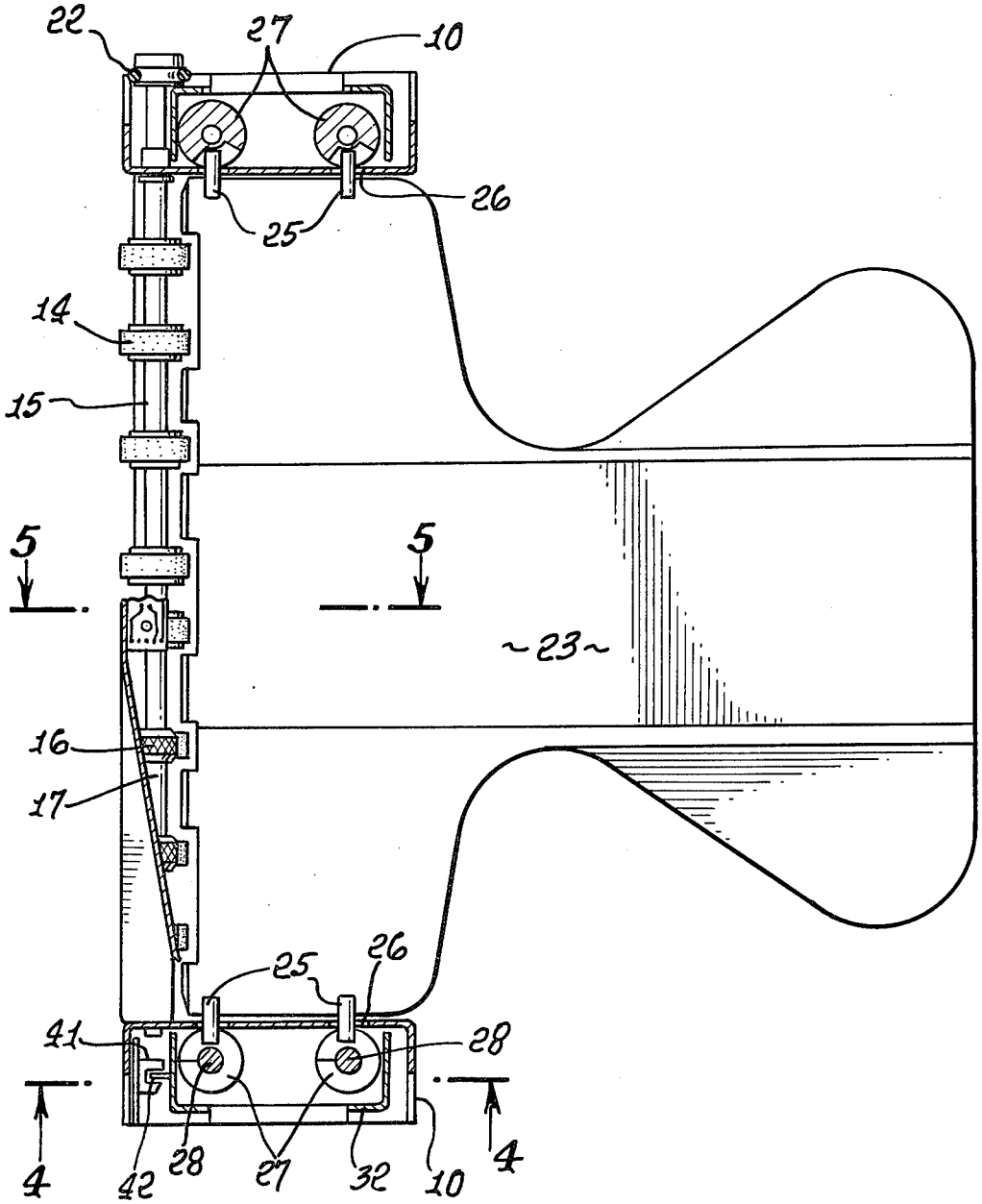
FIG. 3 is a fragmentary horizontal section on the line 3—3 of FIG. 2.
Figure 4:
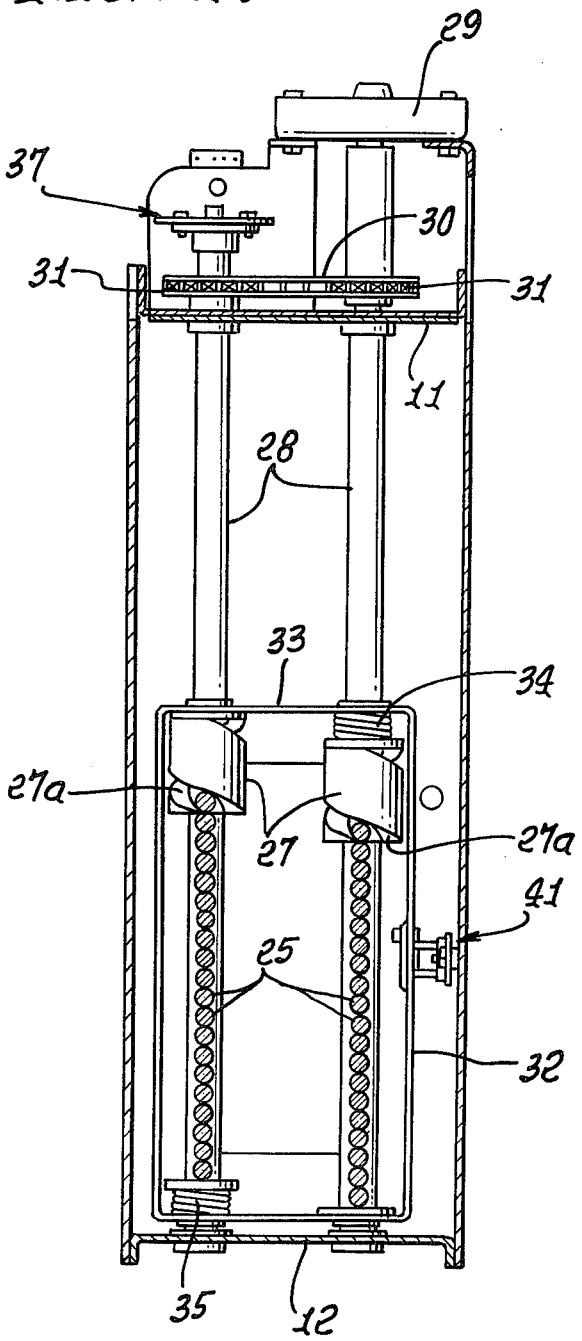
FIG. 4 is a vertical section on the line 4—4 of FIG. 3.
Figure 5:
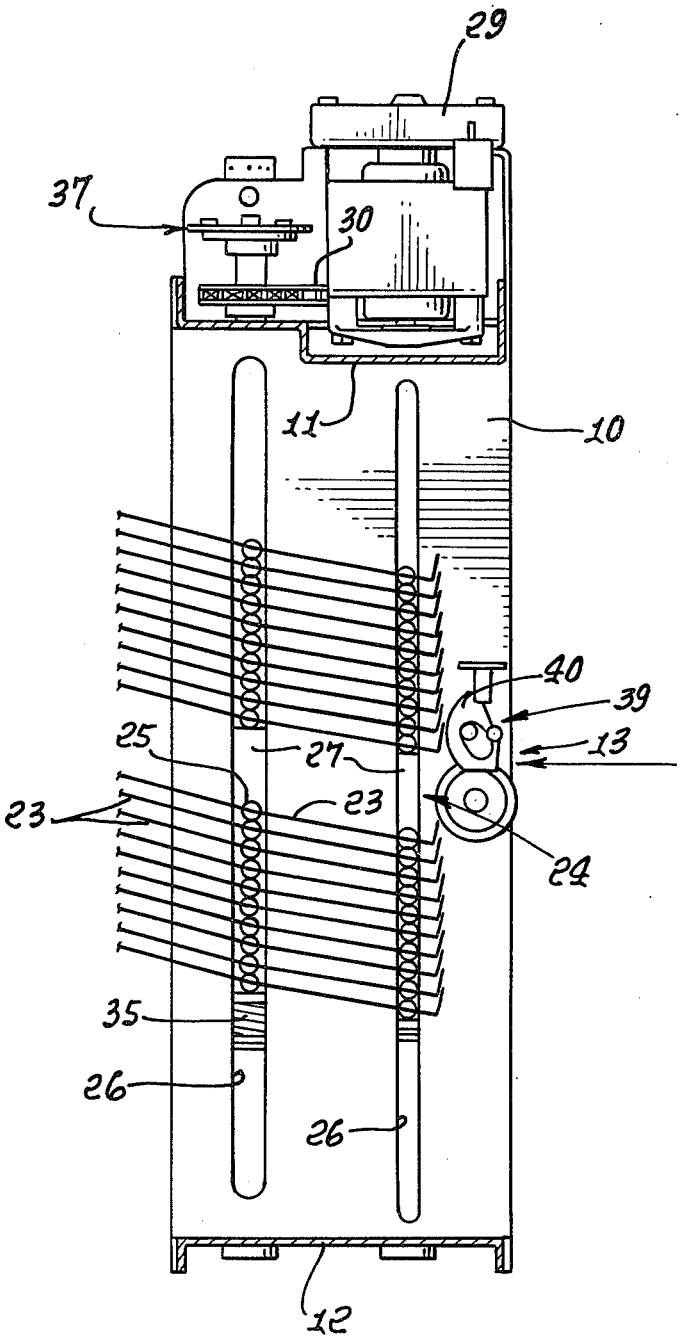
FIG. 5 is a fragmentary vertical section on the line 5—5 of FIG. 3.
Figure 6:
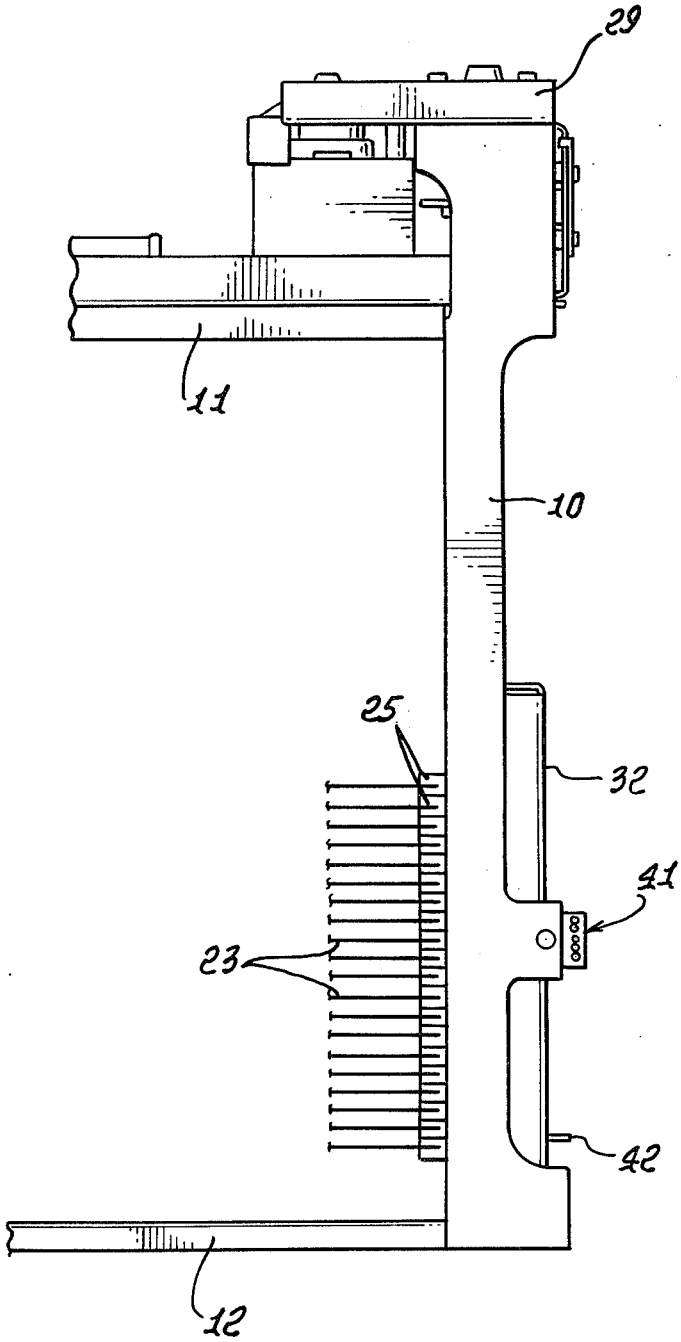
FIG. 6 is a fragmentary elevation on the line 6—6 of FIG. 1.
Figure 7:
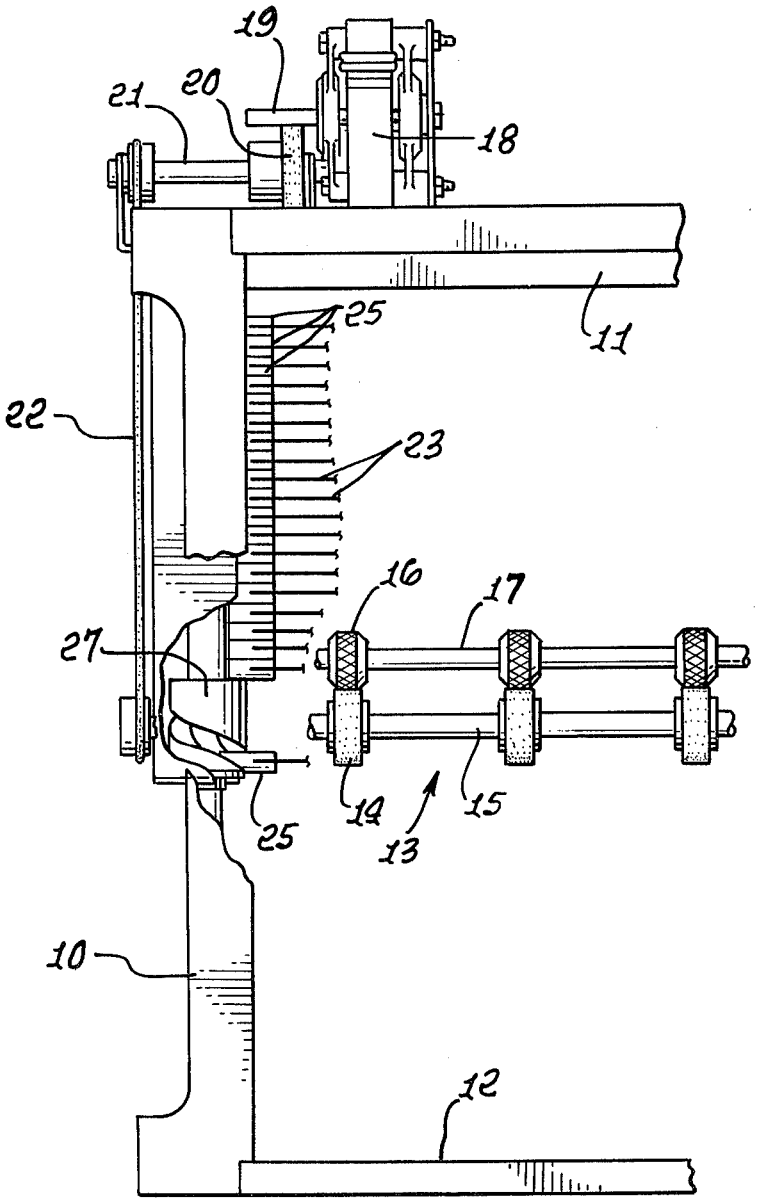
FIG. 7 is a fragmentary vertical section on the line 7—7 of FIG. 1.

As seen in the drawings, a copy machine C has a sorter S applied thereto, whereby original sheets may be successively fed to the copier and a plurality of copies are sorted into collated sets. Such copy machines are well known wherein the original is reproduced by the process of xerography or electrostatography.

It is not necessary to an understanding of the invention to disclose the specifics of the copying apparatus and process, since these are well known in the art. Schematic illustration of such copying apparatus and a description of its operation are found, for example, in U.S. Pat. No. 3,990,695.

In use, original material to be copied is supplied to the copier for reproduction of a selected number of copies which are transported to the sorter by transport rollers or other known transport means T incorporated in the copier.

The sorter of the present invention is operable to receive, in a non-sort mode, a number of copies of a single sheet, or, in a sort mode, to receive and collate sets of copies of plural originals supplied to the copier in succession. In the illustrated sorter, provision is made for collating twenty sets of copies, but it will be understood that the principals of the invention may be employed in sorters capable of collating more or less than twenty sets.

The sorting machine may be positioned to receive sheets from the copier in various ways, such as on a slide, or by hinge means adapted to permit separation between the copier and sorter in the event of a sheet misfeed, or by suitable support brackets.

Frame structure for the sorting machine includes a box like structure having opposed sides 10, a top support 11 and a base 12. Auxilary sheet transport means 13 are provided to receive sheets from the copier, including driven rolls 14 on a shaft 15 which extends horizontally between the sides 10 and knurled pinch rolls 16 on a shaft 17 which extends between the side walls. A drive motor 18 has an output shaft 19 frictionally engaging a resilient drive disc 20 mounted on a transport drive shaft 21 supported on top of the frame structure. A belt 22 is driven by shaft 21 and drives the transport shaft 15.

The transport 13 may take various forms, depending upon the copier or sheet source with which the sorting machine is associated. In some cases, the transport may not be required when the copier output transport is positioned to drive sheets into the sorting bins 23 at the sheet entry location 24.

The bins are formed to receive a number of sheets of a variety of sizes and are transversely arched so that sheets are curved and will not sag over the sides or ends of the bins. In addition the edges of the bins are contoured to facilitate lateral or endwise removal of sets of sheets from the bins.

In the illustrated embodiment, twenty bins are shown as being supported at their inner ends within the frame structure, and as having outer ends which extend freely and outwardly from the frame structure. At opposite sides of the inner ends of the bins are pairs of laterally projecting, horizontally spaced trunnions 25 which project through pairs of vertically extended, parallel slots 26 in the opposite sides 10 of the frame structure. The trunnions engage one another to support the bins and maintain the bins in closely spaced, parallel relation above and below the sheet entry location 24. At the sheet entry location, the adjacent bins are widely spaced to facilitate sheet entry by pairs of bin transfer members 27 which are shown as helical cams mounted on a pair of vertically extended rotary shafts 28 which extend between the top wall 10 and the base 12 of the frame structure.

These transfer members are adapted to be synchronously rotated by a drive motor 29 mounted on the top wall 10 of the frame structure. Motor 29 drives a chain 30 which extends about drive sprockets 31 on the respective transfer shafts 28. Suitable control means, later to be described, controls the operation of motor 29 so that shafts 28, and therefore cams 27, are rotated intermittently through one revolution and in the desired direction to successively move the bins upwardly or downwardly during the sorting operations.

The trunnions 25 of the bins are biased towards one another and towards the transfer cams at opposite sides. A cage 32 has upper and lower cross members 33 through which the shafts 28 extend. The cage is of a height to receive the trunnions and the transfer cams, plus a coiled compression spring 34 disposed about one shaft 28 and another coiled spring 35 disposed the other shaft 28. Spring 34 acts upwardly on the cage 32 between upper cage wall 33 and the upper trunnion ends between it and one of the cams 27, and spring 35 acts downwardly on the cage 32 between lower cage wall 33, and the lower trunnion ends between it and the other cam 27.

One pair of trunnions on each side of the bins is positioned in the spiral cam track **27*a*** and the next adjacent trunnion is spring loaded against the transverse end wall of the cam. Thus, a uniform compressive force is maintained on the trunnions urging them into the cam tracks during operation.

When, the bins contain a number of sheets, considerable weight tends to act downwardly resisting upward movements of the bins. Therefore, a counterbalance spring 36, at each side of the assembly, is interconnected between the upper frame structure and the respective cages.

As previously indicated, a control system for the drive motor 29 is adapted to limit the rotation of the transfer cams to one revolution. As shown, a one revolution switch 37 is associated with one of the transfer shafts 28. The switch includes a notched disc 38 rotatable with the shaft 28 relative to a light source and detector. A control signal is also provided in responses to entry of a sheet into the sorter to initiate operation of the transfer means. Thus, a sheet detector switch 39 is provided at the sheet entry location, including a sheet detector 40 and a cooperative light source and light detector. Additionally, when the bins are all in the down or home position, the control system should be rendered inoperative during the feeding of sheets into the upper tray in a non-sort mode of operation. Such a switch 41 includes a member 42 on one of cages 32 and a cooperative light source and sensor on the frame structure.

OPERATIONS

Figure 8:
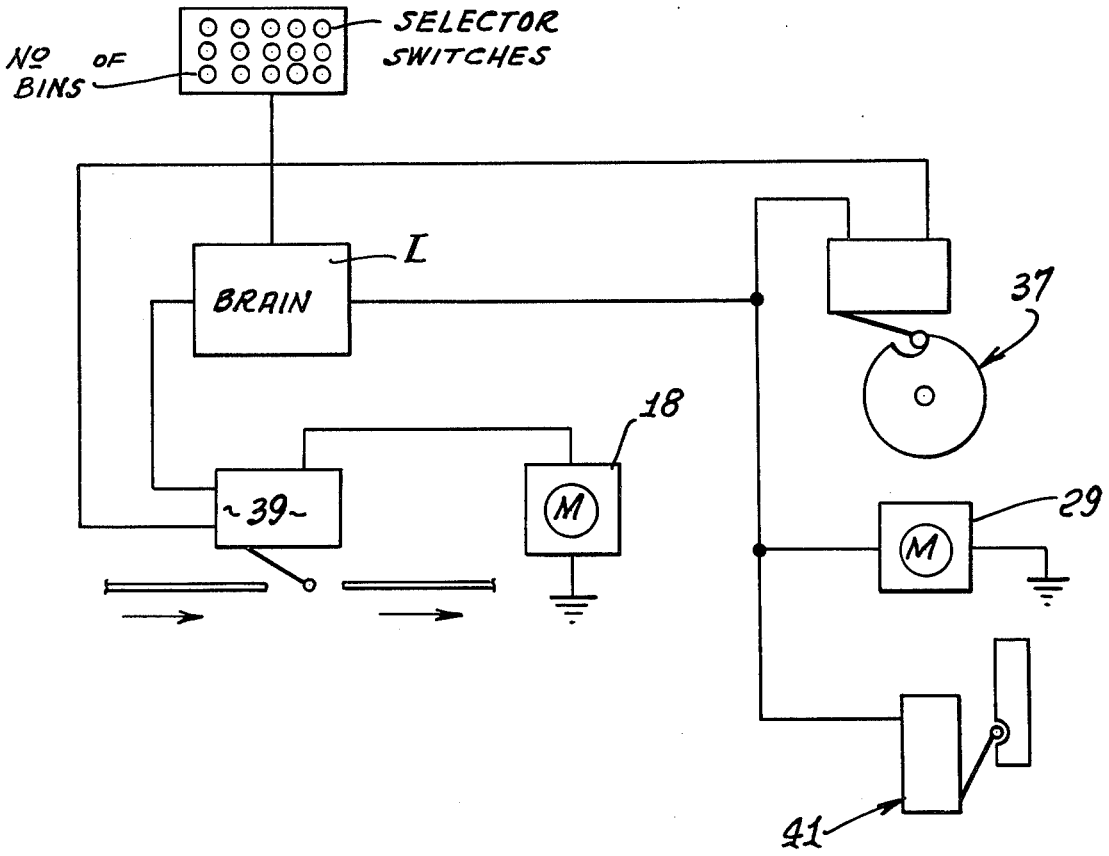
FIG. 8 is a schematic showing the control system.

These control elements or switches are shown in the schematic diagram of FIG. 8, to which reference is made in the following description of the operation of the apparatus. In operation, a suitable logic unit L is employed to establish a mode of operation in response to activation of suitable selector switches. When sorting is desired a number of bins switch is actuated, say 10 bins for 10 sets. As originals are supplied to the copier machine 10 copies will be successively supplied to the transport 13, at which the presence of a sheet is detected by the sheet detector switch 39. As the sheet leaves the sheet detector switch, the motor 29 is energized to rotate in a direction in which the upper tray will be moved upwardly in response to rotation of the cams 27, as the trunnions 25 of the upper bin are displaced from the cam tracks **27*a*. One revolution switch 37 then interrupts the motor current and the sorter is conditioned to receive the second copy, and so on until 10 copies have been received in the 10 upper trays. Thereupon, the logic L will reverse the motor 29 so that the next copy which is a copy of a second original, leaving the transport enables detector switch 39 to cause energization the motor to move the lOth bin downwardly, and so on until the motor is again reversed following entry of the 20th copy. Following the sorting operation, all trays can be caused to be moved downwardly in response to a time delay sufficient to indicate that a copy run is complete. Movement of all bins downwardly is detected by the home switch 41 to cause denergization of the motor 29**.

From the foregoing it will be recognized that the invention provides a simple sheet sorter of very compact construction, in which the parallel relation maintained between bins and the wide space between bins during feeding of sheets into the bins enables the sorter to receive a substantial number of sheets.

I claim:

1. Sorting apparatus of the shiftable bin type, including a frame structure having means for mounting the apparatus at the sheet outlet from a copying machine, sorting bins mounted at one of their ends in said frame structure and shiftable relative to one another to provide a wide sheet entry between bins, and means for shifting said bins: the improvement wherein said bin shifting means includes pairs of rotary bin shifting members at opposite sides of said bins adjacent said one end, means for rotating said bin shifting members, said bins having pairs of support members at opposite sides thereof adjacent said one end and engageable with said bin shifting members to support said bins in parallel relation when said bins are widely spaced and engageable with adjacent support members to support said bins in parallel closely spaced relation, the other ends of said bins extending freely from said frame structure.

2. Sorting apparatus as defined in claim 1, said bin lifting members being in the form of rotary spiral cams, said support members being in the form of pairs of laterally extended trunnions, and including spring means for biasing said trunnions in opposite directions towards said spiral cams.

3. Sorting apparatus as defined in claim 1, said bin shifting members each being in the form of spiral cams having a cam track for receiving successive bin support members upon rotation of said spiral cams in either direction, spring means biasing said bin support members in opposite directions towards said spiral cams and means for rotating said spiral cams in unison.

4. Sorting apparatus as defined in claim 1, said bin shifting members being in the form of rotary spiral cams, a pair of shafts rotatable in said frame structure and carrying said cams, a cage reciprocably mounted on said shafts, said bin support members being in the form of pairs of trunnions extending into said cage and engageable by said cams, and oppositely acting springs interposed between one of said cams and one end of said cage and between the other of said cams and the other end of said cage to bias said trunnions in opposite directions towards said cams.

* * * * *